US009103515B1

(12) United States Patent
Wang

(10) Patent No.: US 9,103,515 B1
(45) Date of Patent: Aug. 11, 2015

(54) REPLACEMENT LED LAMP MODULE FOR STREET LIGHT

(71) Applicants: Tzu Wang, Taoyuan County (TW); Pie-Jung Wang, Taoyuan County (TW)

(72) Inventor: Tzu Wang, Taoyuan County (TW)

(73) Assignee: HABEMIT INTERNATIONAL CO. LTD., Taoyuan County (TW)

( * ) Notice: Subject to any disclaimer, the term of this patent is extended or adjusted under 35 U.S.C. 154(b) by 0 days.

(21) Appl. No.: 14/265,282

(22) Filed: Apr. 29, 2014

(51) Int. Cl.

| | |
|---|---|
| ***F21S 8/08*** | (2006.01) |
| ***F21V 29/00*** | (2015.01) |
| ***F21K 99/00*** | (2010.01) |
| ***F21V 31/00*** | (2006.01) |

(52) U.S. Cl.
CPC . *F21S 8/085* (2013.01); *F21K 9/30* (2013.01); *F21V 29/20* (2013.01); *F21V 31/005* (2013.01)

(58) Field of Classification Search
USPC ..... 362/431, 362, 373, 249.02, 294, 218, 362/547
See application file for complete search history.

(56) References Cited

U.S. PATENT DOCUMENTS

| | | | | |
|---|---|---|---|---|
| 2013/0010464 | A1* | 1/2013 | Shuja et al. | 362/235 |
| 2013/0051038 | A1* | 2/2013 | Lee | 362/382 |
| 2013/0279172 | A1* | 10/2013 | Wang | 362/294 |

* cited by examiner

*Primary Examiner* — Laura Tso
(74) *Attorney, Agent, or Firm* — Chun-Ming Shih; HDLS IPR Services

(57) ABSTRACT

A replacement LED lamp module for a street light includes a heat dissipating cover (10), a driver (20), and an LED module (30). The heat dissipating cover (10) has a receiving cavity (14) and a receiving recess (15) disposed inward of a bottom of the heat dissipating cover (10). The driver (20) is installed in the receiving cavity (14). The LED module (30) is disposed corresponding to the receiving recess (15) and fixed to the heat dissipating cover (10); the LED module (30) is electrically connected to the driver (20). Thus, the replacement of the LED lamp module can be achieved without affecting the main structure of the conventional street light.

8 Claims, 8 Drawing Sheets

REPLACEMENT LED LAMP MODULE FOR STREET LIGHT

BACKGROUND OF THE INVENTION

1. Field of the Invention

The present invention relates to an LED (Light Emitting Device) lamp module and, in particular, to an LED lamp module for a street light.

2. Description of Related Art

Traditional street lights are quite common to be used in city streets, highways, and tunnels. They not only beautify the city, but also significantly improve the traffic safety and public order. However, with the developments of the times and the LED street lights as new energy, replacing the traditional street lights with the LED ones, which extends the lifetime of the street lights and lowers energy consumption and carbon emissions, obviously becomes a main research topic worldwide at the current stage.

Therefore, related manufacturers have developed LED street lights having various shapes or meeting various specifications. However, the developed LED street lights are not compatible with the currently traditional street lights. Thus, the traditional replacement of the street light is mostly made by a complete replacement, which signifies the high cost of the LED street light and the large manpower and associated equipment for the replacement. Accordingly, people desiring the replacement may step back, which needs to be overcome.

SUMMARY OF THE INVENTION

It is an objective of the present invention to provide a replacement LED lamp module for a street light, which can achieve the replacement of a lighting module without affecting the main structure of a traditional street light.

The present invention provides a replacement LED lamp module for a street light. The replacement LED lamp module comprises a heat dissipating cover, a driver, and an LED module. The heat dissipating cover has a receiving cavity and a receiving recess disposed inward of a bottom of the heat dissipating cover. The driver is installed in the receiving cavity. The LED module is disposed corresponding to the receiving recess and fixed to the heat dissipating cover. The LED module is electrically connected to the driver.

The present invention also has the following effects. Heat generated by the LED module is dissipated via a thermal module, which enhances heat dissipation efficiency and extends the lifetime of the lighting unit of the LED module. By means of a fixture module, the LED lamp module of the present invention can be directly combined with the upper cover of the traditional street light to considerably reduce the manpower and the cost of the associated equipment.

DETAILED DESCRIPTION OF THE INVENTION

Figure 1:
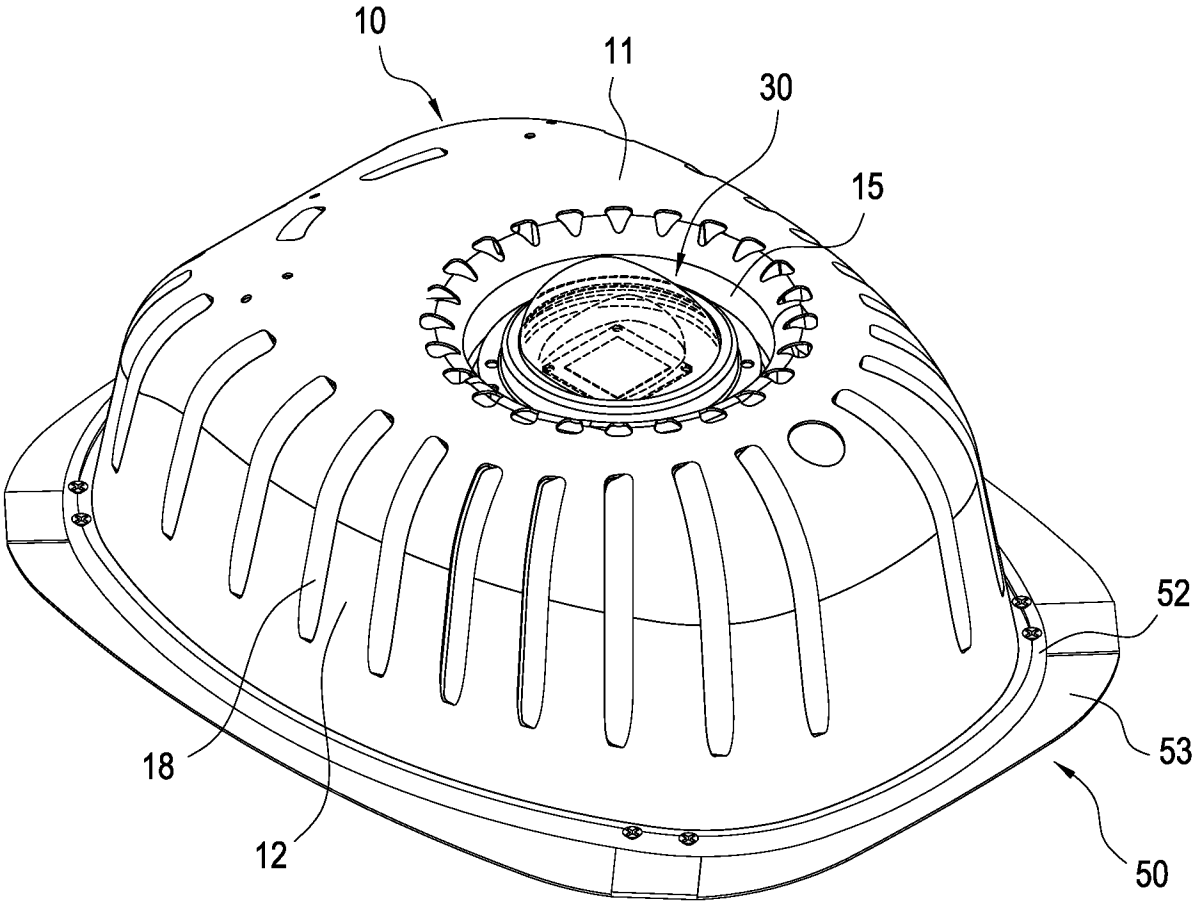
FIG. 1 is an assembled view of the replacement LED lamp module of the present invention.
Figure 2:
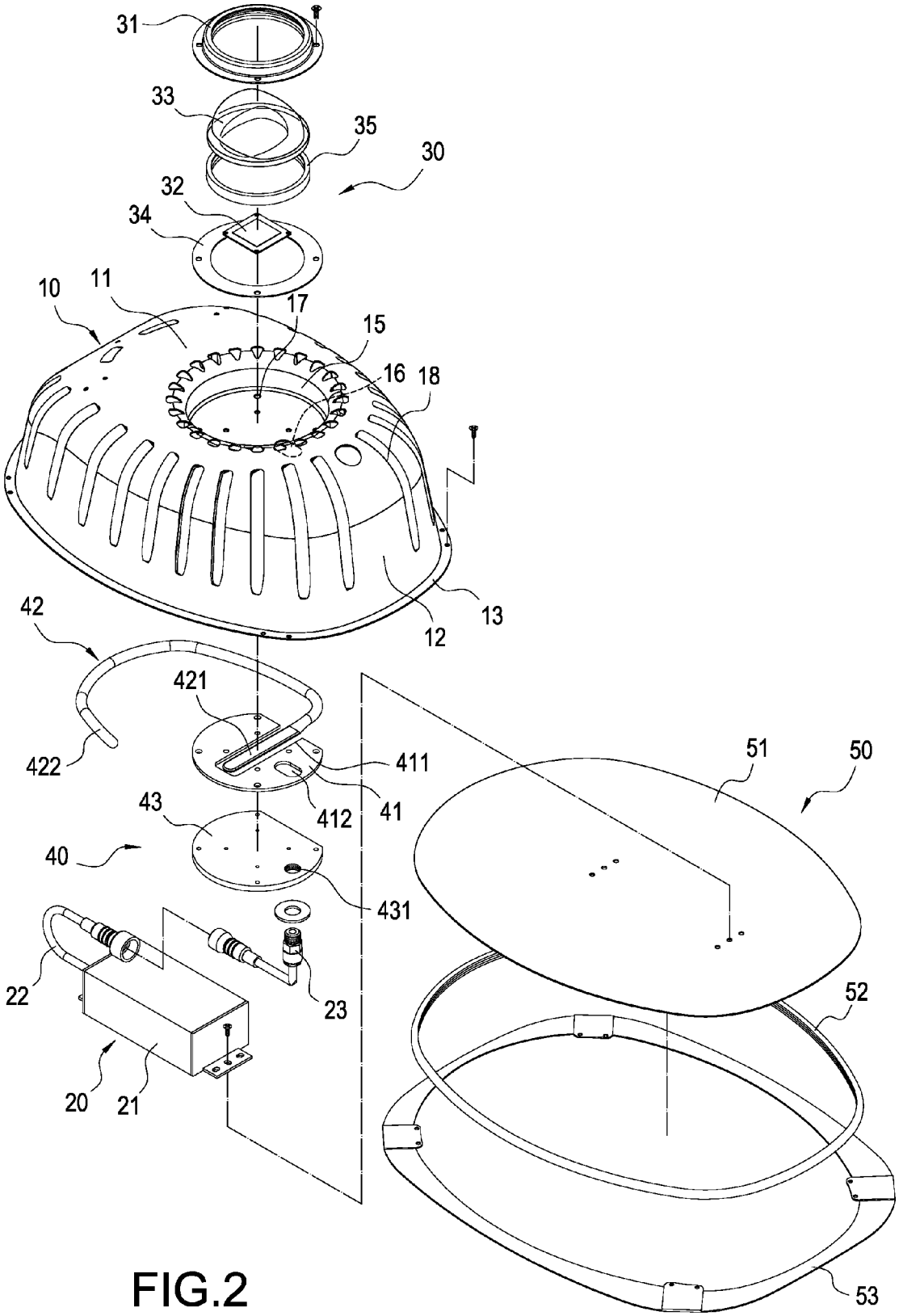
FIG. 2 is an exploded view of the replacement LED lamp module of the present invention.
Figure 3:
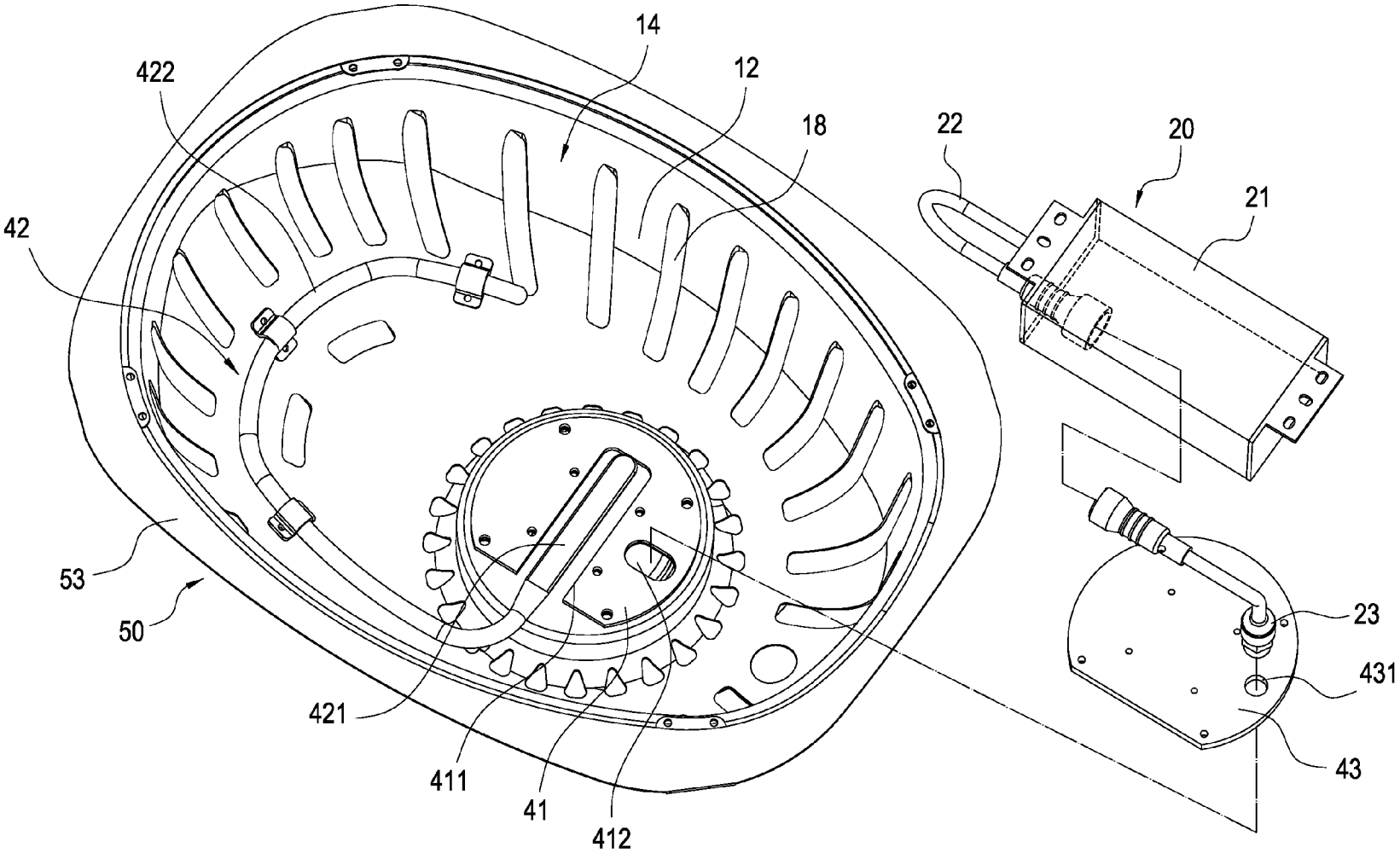
FIG. 3 shows partial exploded views of the heat dissipating cover, the thermal module, and the driver of the present invention.
Figure 4:
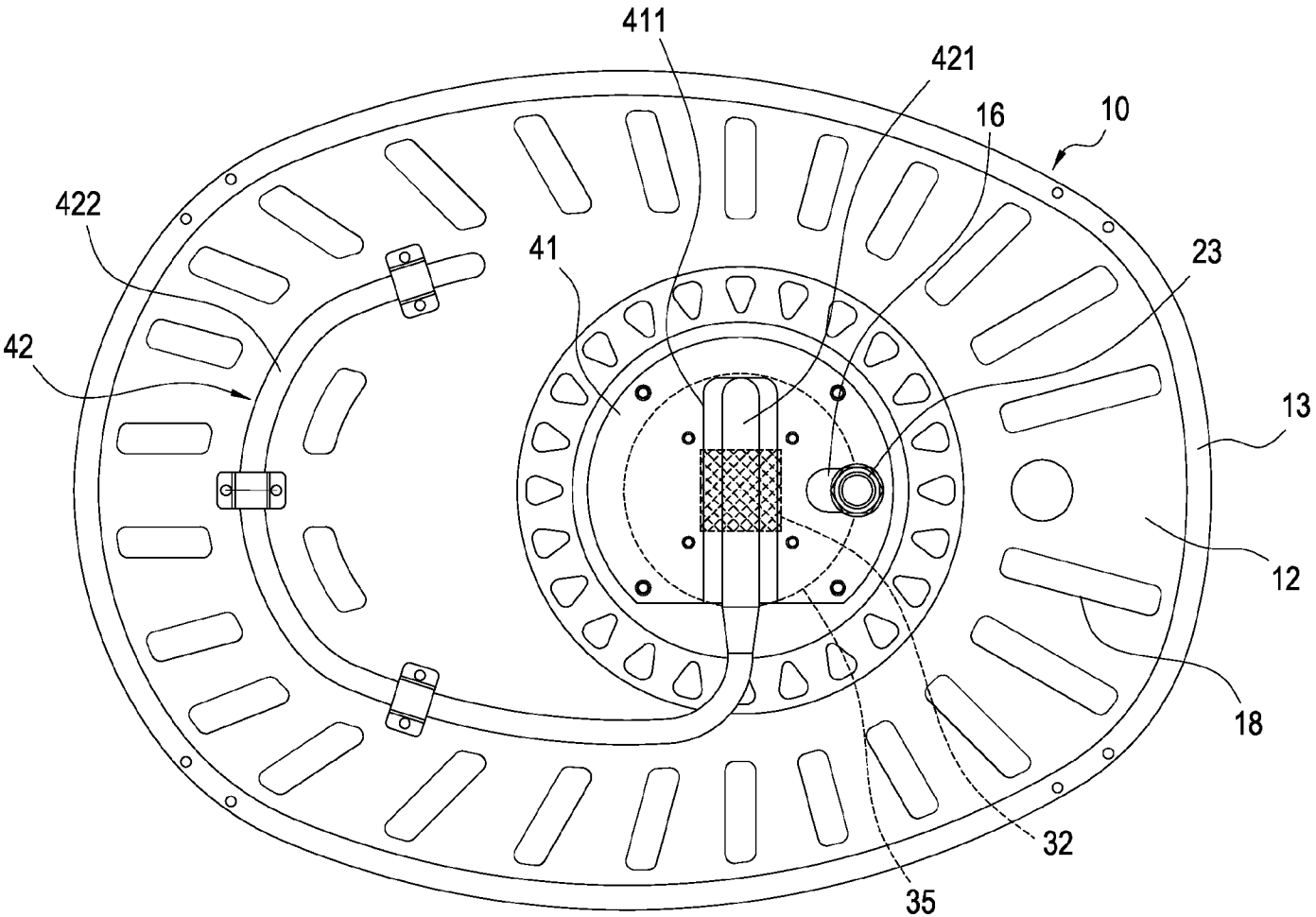
FIG. 4 is a top view of the heat dissipating cover in combination with the thermal module of the present invention.

The detailed description and technical details of the present invention will be explained below with reference to accompanying figures. However, the accompanying figures are only for reference and explanation, but not to limit the scope of the present invention.

Please refer to FIGS. 1-4. The present invention provides a replacement LED lamp module for a street light. The replacement LED lamp comprises a heat dissipating cover 10, a driver 20, and an LED module 30.

The heat dissipating cover 10, which is made of metal such as aluminum, comprises a base plate 11 having an oval-like shape and a surrounding plate 12 bending upward from an edge of the base plate 11. A folding edge 13 is formed at an end portion of the surrounding plate 12 away from the base plate 11. The shape of the heat dissipating cover 10 is similar to that of the translucent cover of the traditional street light. A receiving cavity 14 is surrounded and formed by the base plate 11 and the surrounding plate 12. A round receiving recess 15 is recessed in a direction from the base plate 11 to the receiving cavity 14. A first hole 16 having a capsule shape and a plurality of second holes 17 are formed on the base plate 11 in the receiving recess 15. Also, a plurality of longitudinal cuts 18 are formed on the surrounding plate 12 such that the gas in the receiving cavity 14 and that out of the heat dissipating cover 10 can be exchanged for heat transfer.

The driver 20 has a main body 21 and a cable 22 electrically connected to the main body 21. A connector 23 is disposed at an end of the cable 22. The driver 20 is installed in the receiving cavity 14. The connector 23 is disposed corresponding to the first hole 16.

The LED module 30 is disposed corresponding to the receiving recess 15 and fixed to the heat dissipating cover 10 and is electrically connected to the driver 20. In the current embodiment, the LED module 30 comprises a collar 31, a lighting unit 32, a lens 33, a washer 34, and a sealing ring 35. The lighting unit 32, which is composed of a substrate and a plurality of LEDs fixed on the substrate, is fixed to a lower surface of the base plate 11 and is electrically connected to the connector 23 of the driver 20 via a butting connector (not shown). The lens 33 is fixed to the collar 31 through the sealing ring 35. The collar 31 presses the washer 34 to be attached to the lower surface of the base plate 11. The collar 31 is fixed to the base plate 11 via fastening elements such as screws such that the lens 33 covers the lighting unit 32 hermetically.

Preferably, the replacement LED lamp module of the present invention further comprises a thermal module 40 which is disposed in the receiving cavity 14 and thermally connected to the heat dissipating cover 10. The thermal module 40 comprises a thermal plate 41, a heat pipe 42, and a fixing plate 43. A long slot 411 is formed in the middle of the thermal plate 41. A slot hole 412 is formed on the right side of the long slot 411. The heat pipe 42 roughly has a "C" shape, which comprises a flat evaporation segment 421 and a condensation segment 422 extending from the evaporation segment 421. The fixing plate 43 has a screw hole 431 for screwing an end of the connector 23. The thermal plate 41 is attached to an upper surface of the base plate 11. The evaporation segment 421 of the heat pipe 42 is attached to the upper surface of the base plate 11 and formed inside the long slot 411. The condensation segment 422 of the heat pipe 42 is attached circularly to the surrounding plate 12. The fixing plate 43 is pressed to contact the evaporation segment 421 of the heat pipe 42 and the top of the thermal plate 41 to provide a screw connection for the collar 31.

Preferably, the replacement LED lamp module of the present invention further comprises a fixture module 50 connected to an open end of the heat dissipating cover 10. The fixture module 50 comprises a separation plate 51, a sealing member 52, and a frame 53. The separation plate 51 caps the heat dissipating cover 10 and is attached to the folding edge 13. The sealing member 52 clamps the folding edge 13 and an edge area of the separation plate 51. The frame 53 is stacked on the sealing member 52. By means of fastening elements such as screws passing through the folding edge 13, the frame 53 and the heat dissipating cover 10 can be fixed to each other (as shown is FIG. 1).

Figure 5:
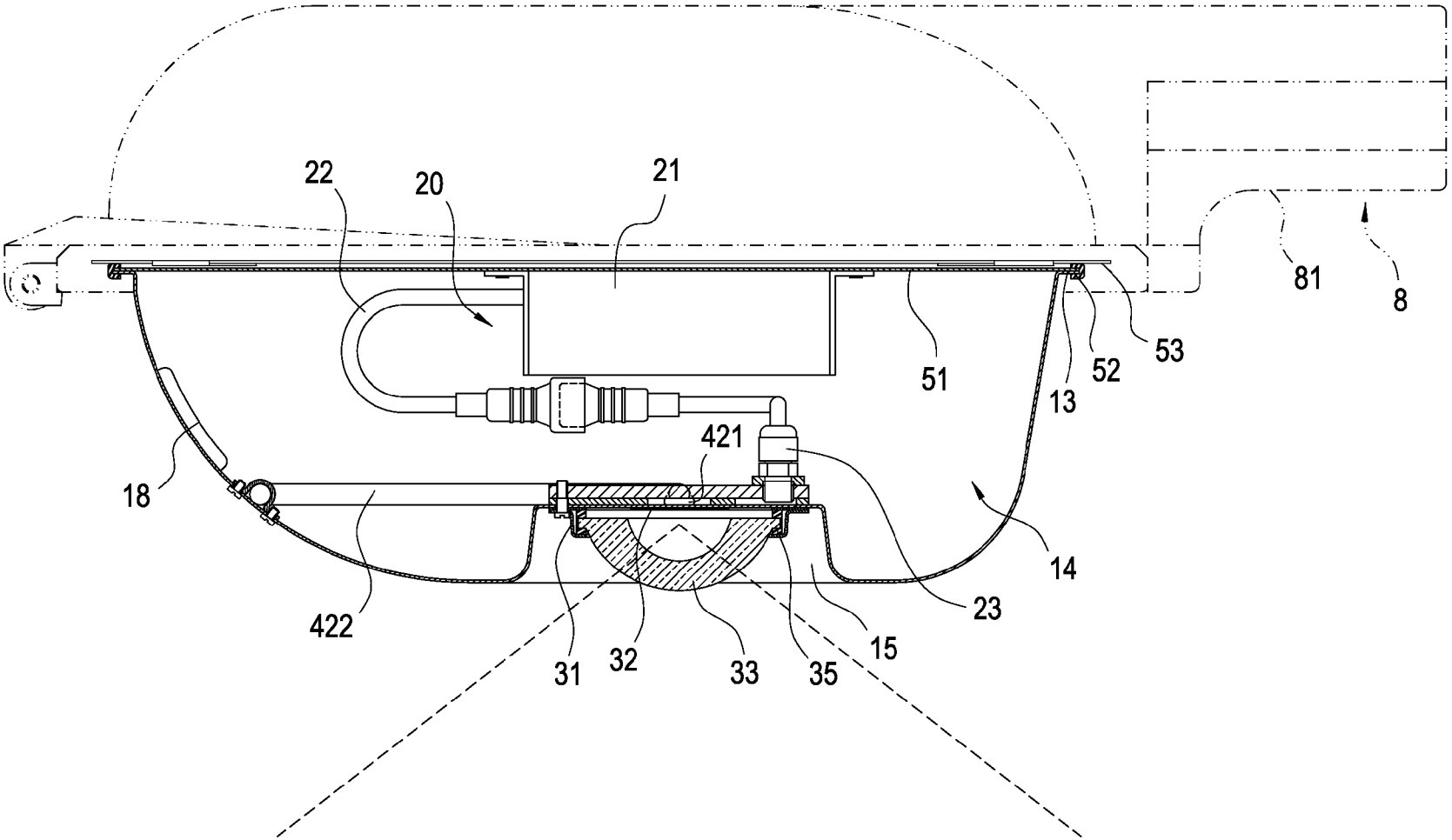
FIG. 5 is an assembled cross-sectional view of the present invention applied in a street light.
Figure 6:
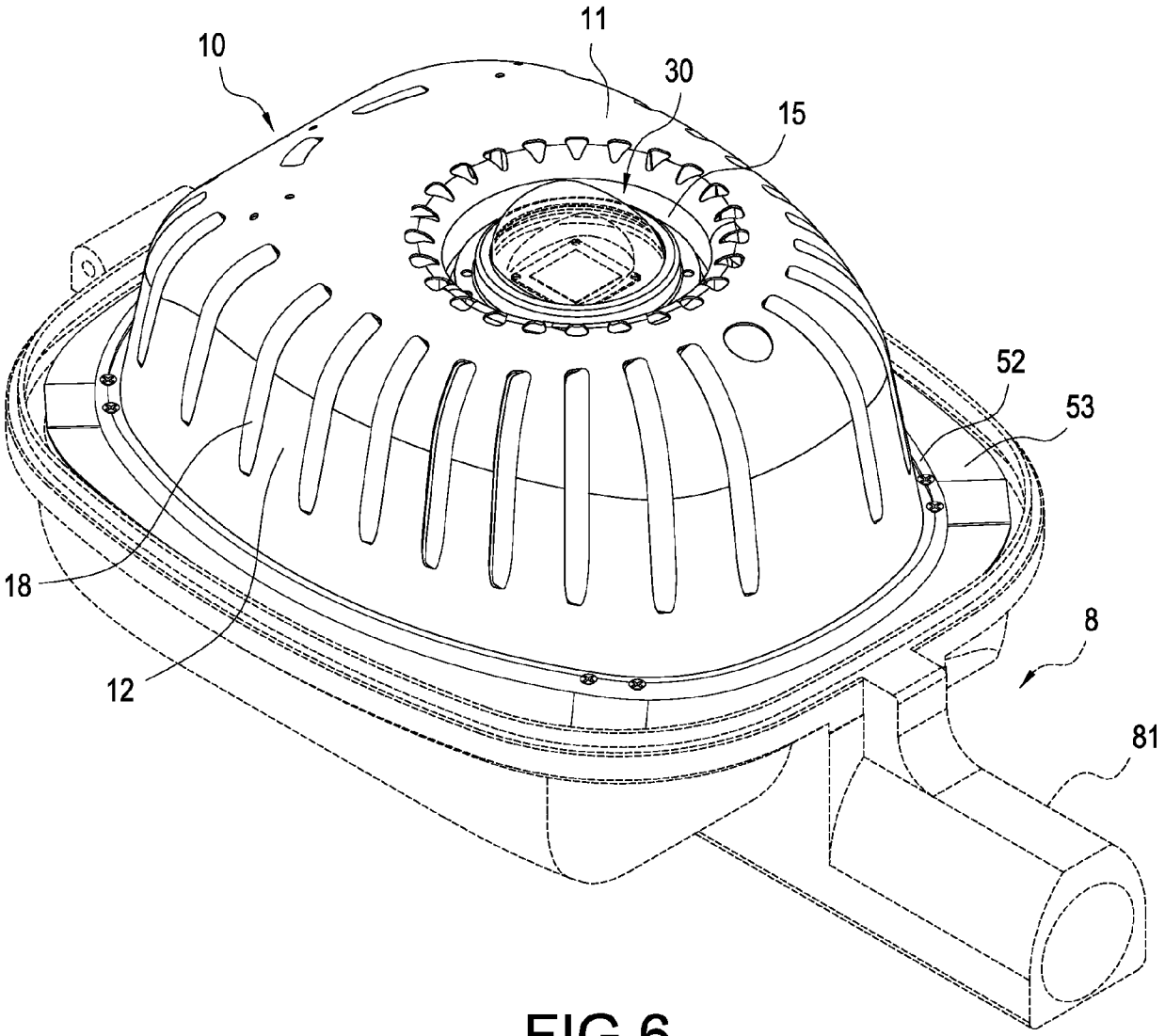
FIG. 6 is an assembled view of the present invention applied in a street light.
Figure 7:
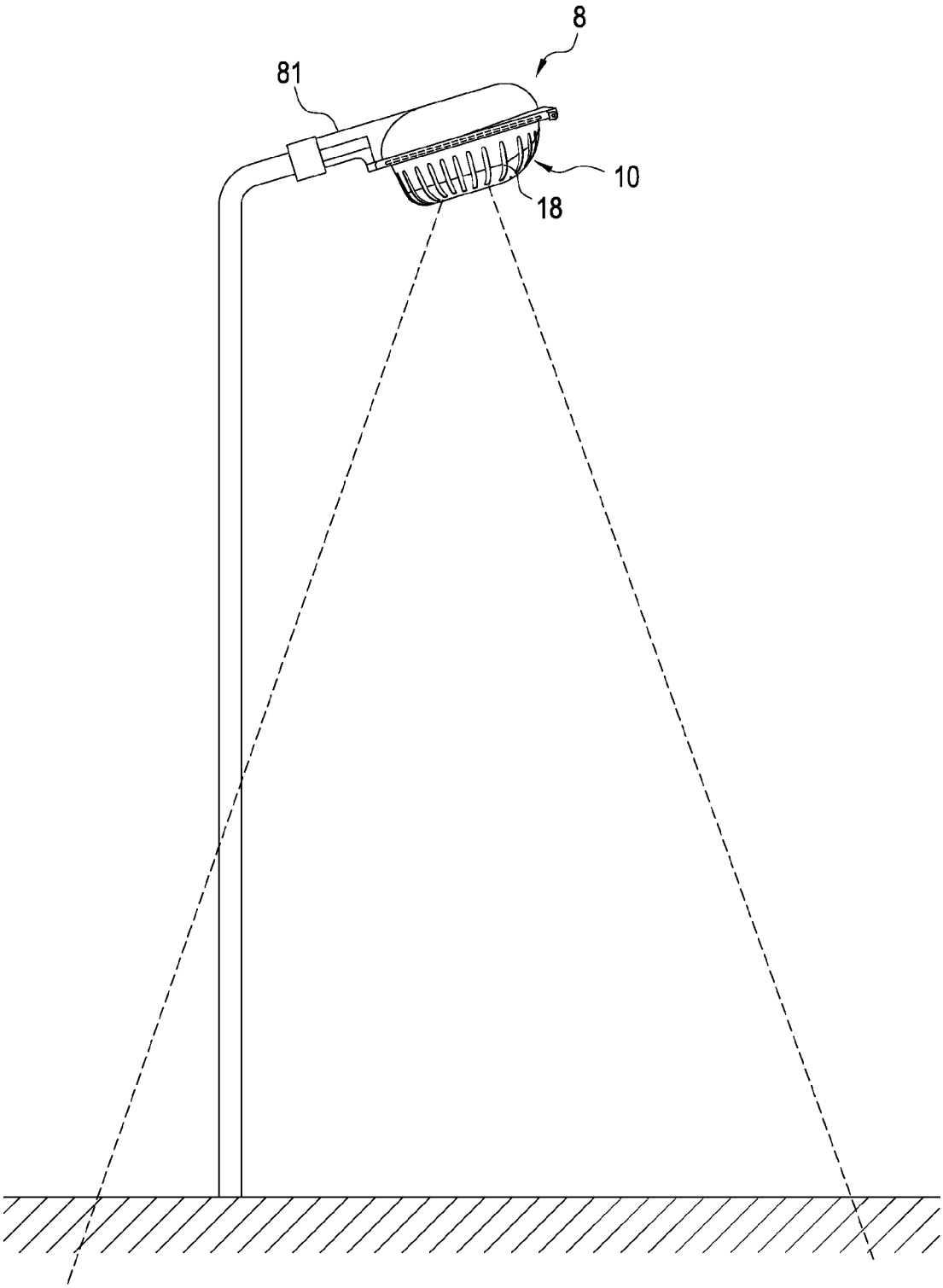
FIG. 7 is an operational view of the present invention applied in a street light.

Please refer to FIGS. 5-7. The replacement LED lamp module of the present invention can be applied in a traditional street light 8 which has a upper cover 81. Since the structure of the present invention can replace the lighting member and light shell of the traditional street light 8, the fixture module 5 can be embedded in the upper cover 81 and can be combined by the clipping mechanism of the traditional street light 8.

The power of the driver 20 comes from the street light 8. After the electric characteristics of voltage/current of the power are modulated and rectified by the main body 21, the power is provided for the lighting unit 32 of the LED module via the cable 22 and the connector 23.

The heat generated by the lighting unit 32 is delivered to the evaporation segment 421 of the heat pipe 42 and the thermal plate 41 via the base plate 11. Some of the heat is delivered and dissipated from the condensation segment 422 to the heat dissipating cover 10 by vapor-to-liquid phase heat transfer in the heat pipe 42. Some of the heat is delivered and dissipated to the fixing plate 43 by thermal conduction via the thermal plate 41.

Since the replacement LED lamp module of the present invention is specifically arranged according to the above-mentioned structure, when it is installed in the street light 8, the illumination range provided by the LED module 30 is basically consistent with that provided by the street light 8.

Figure 8:
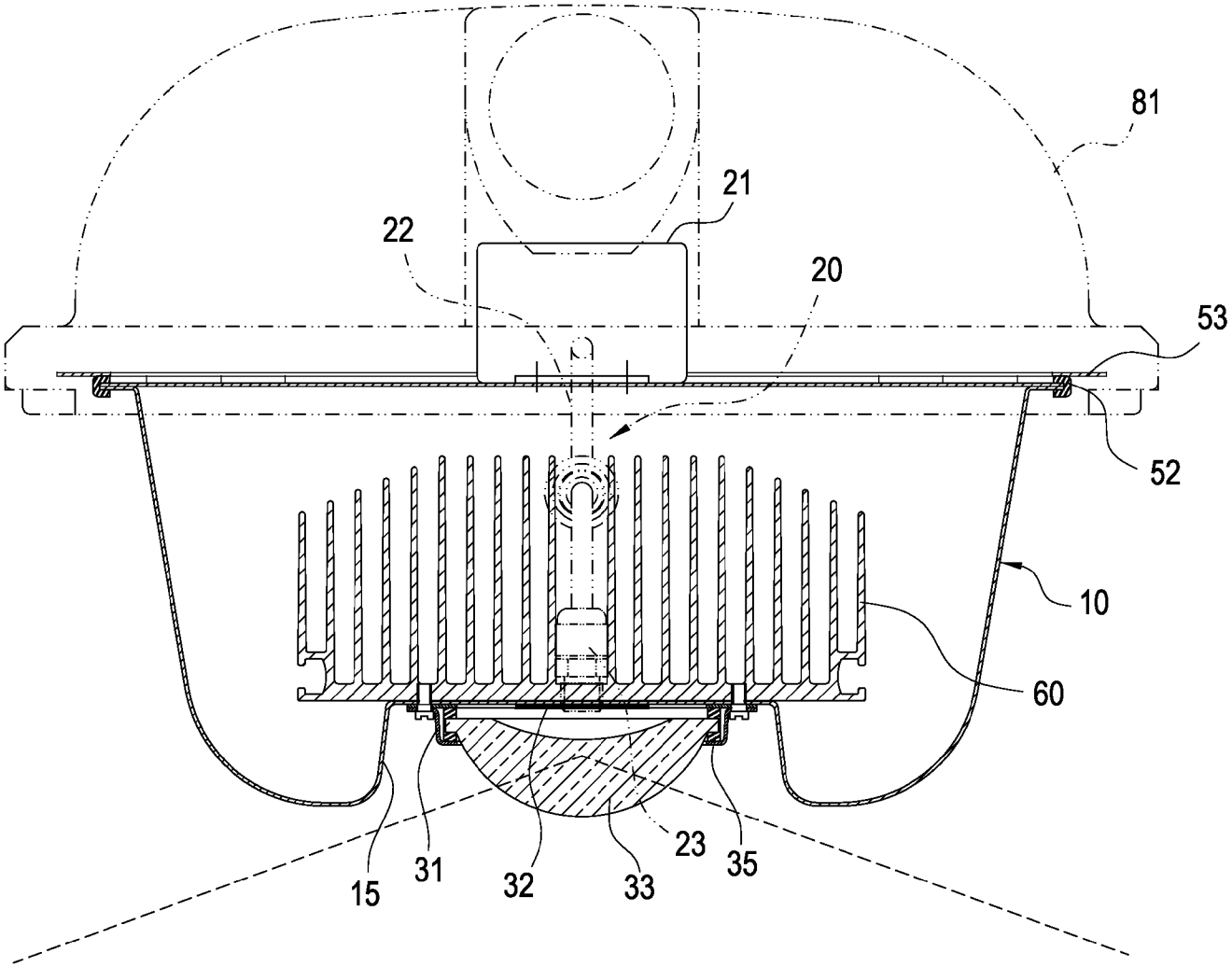
FIG. 8 is a cross-sectional view of the present invention according to another embodiment.

Please refer to FIG. 8. The replacement LED lamp module of the present invention can be implemented as the above embodiments. Besides, for a high power lighting unit (i.e., an electric power between 60 W and 80 W or between 100 W to 120 W), a heat dissipator 60 can be additionally installed to the current embodiment. The heat dissipator 60 is made of aluminum material by extrusion molding and has a substrate thermally contacted to the upper surface of the base plate 11 and has a plurality of fins extending upwards from the substrate. The fins are spacedly arranged for enhanced heat dissipation.

In summary, the replacement LED lamp module of the present invention can achieve the expected objective and overcome the disadvantages of the prior art. Also it is indeed novel, useful, and non-obvious to be patentable. Please examine the application carefully and grant it as a formal patent for protecting the rights of the inventor.

What is claimed is:

1. A replacement LED lamp module for a street light, comprising:

a heat dissipating cover (10) having a receiving cavity (14) and a receiving recess (15) disposed inward of a bottom of the heat dissipating cover (10);

a driver (20) installed in the receiving cavity (14); and an LED module (30) disposed corresponding to the receiving recess (15) and fixed to the heat dissipating cover (10), wherein the LED module (30) is electrically connected to the driver (20), wherein the heat dissipating cover (10) is made of metal and comprises a base plate (11) and a surrounding plate (12) bending upward from an edge of the base plate (11), wherein the receiving cavity (14) is surrounded and formed by the base plate (11) and the surrounding plate (12);

wherein the receiving recess (15) is recessed in a direction from the base plate (11) to the receiving cavity (14), wherein a plurality of longitudinal cuts (18) are formed on the surrounding plate (12).

2. A replacement LED lamp module for a street light, comprising:

a heat dissipating cover (10) having a receiving cavity (14) and a receiving recess (15) disposed inward of a bottom of the heat dissipating cover (10);

a driver (20) installed in the receiving cavity (14); and an LED module (30) disposed corresponding to the receiving recess (15) and fixed to the heat dissipating cover (10), wherein the LED module (30) is electrically connected to the driver (20), wherein the heat dissipating cover (10) is made of metal and comprises a base plate (11) and a surrounding plate (12) bending upward from an edge of the base plate (11), wherein the receiving cavity (14) is surrounded and formed by the base plate (11) and the surrounding plate (12);

wherein the LED module (30) comprises a collar (31), a lighting unit (32), and a lens (33), wherein the lighting unit (32) is fixed to the base plate (11) and connected to the driver (20) via a connector (23), wherein the lens (33) covers the lighting unit (32), wherein the collar (31) is sleeved around the lens (33) to be fixed to the base plate (11).

3. The replacement LED lamp module for the street light according to claim 2, wherein the LED module (30) further comprises a washer (34) and a sealing ring (35), wherein the washer (34) is clamped between the base plate (11) and the collar (31).

4. The replacement LED lamp module for the street light according to claim 2, wherein the LED module (30) further comprises a sealing ring (35), wherein sealing ring (35) is clamped between the collar (31) and the lens (33).

5. The replacement LED lamp module for the street light according to claim 1, further comprising a thermal module (40) disposed in the receiving cavity (14) and thermally connected to the heat dissipating cover (10).

6. The replacement LED lamp module for the street light according to claim 5, wherein the thermal module (40) comprises a thermal plate (41), a heat pipe (42), and a fixing plate (43), wherein the thermal plate (41) and an end of the heat pipe (42) correspond to the LED module (30) to be attached to the base plate (11), wherein the fixing plate (43) is pressed to contact the end of the heat pipe (42) and the top of the thermal plate (41), wherein the other end of the heat pipe (42) is circularly attached to the surrounding plate (12).

7. A replacement LED lamp module for a street light, comprising:

a heat dissipating cover (10) having a receiving cavity (14) and a receiving recess (15) disposed inward of a bottom of the heat dissipating cover (10);

a fixture module (50) connected to an end of the heat dissipating cover (10) away from the base plate (11);

a driver (20) installed in the receiving cavity (14); and an LED module (30) disposed corresponding to the receiving recess (15) and fixed to the heat dissipating cover (10), wherein the LED module (30) is electrically connected to the driver (20), wherein the heat dissipating cover (10) is made of metal and comprises a base plate (11) and a surrounding plate (12) bending upward from an edge of the base plate (11), wherein the receiving cavity (14) is surrounded and formed by the base plate (11) and the surrounding plate (12);

wherein the fixture module (50) comprises a separation plate (51), a sealing member (52), and a frame (53), wherein a folding edge (13) is formed at an end portion of the surrounding plate (12), wherein the separation plate (51) is attached to the folding edge (13), wherein the sealing member (52) clamps the folding edge (13) and an edge of the separation plate (51), wherein the frame (53) is stacked on the sealing member (52).

8. The replacement LED lamp module for the street light according to claim 1, further comprising a heat dissipator (60) corresponding to the LED module (30) to be attached to the base plate (11).

* * * * *